US006017262A

United States Patent [19]

Starnes

[11] Patent Number: 6,017,262

[45] Date of Patent: Jan. 25, 2000

[54] TONGUE SNATCHING CREEPER TOY

[76] Inventor: Byron S. Starnes, 21659 E. Otero Pl., Aurora, Colo. 80016

[21] Appl. No.: 09/192,223

[22] Filed: Nov. 16, 1998

[51] Int. Cl.[7] ..... A63H 13/10

[52] U.S. Cl. ..... 446/308; 446/268; 446/176

[58] Field of Search ..... 446/176, 183, 446/185, 268, 308, 311, 320, 337, 901

[56] References Cited

U.S. PATENT DOCUMENTS

| | | | |
|---|---|---|---|
| 325,141 | 8/1885 | Wilke | 446/304 |
| 985,746 | 2/1911 | Lewis | 446/304 |
| 3,108,395 | 10/1963 | Goldfarb | 446/257 X |
| 3,353,823 | 11/1967 | Sobel | 446/183 X |
| 3,577,676 | 5/1971 | Powell | 446/183 |
| 3,738,054 | 6/1973 | Petrusek | 46/141 |
| 4,689,033 | 8/1987 | Droller et al. | 446/183 |
| 5,391,106 | 2/1995 | Lidert, Jr. | 446/337 |

*Primary Examiner*—Sam Rimell

*Attorney, Agent, or Firm*—Patent & Trademark Services; Thomas Zack; Joseph H. McGlynn

[57] ABSTRACT

An animated toy with an extendible tongue appendage that can be retracted back towards the opened mouth of the toy creature. In the first preferred embodiment an inner spring and outer spring are used, respectively, to propel the tongue away from the creature's body and to retract the extended tongue. In another second embodiment, the body of the creature is hollow, deformable and resilient with an internal air chamber. Air pressure in this chamber is used in place of the springs to extend and retract the hollow tongue. In a third embodiment, similar to the second embodiment in operation, pressurized air is supplied by an external bellows to extend the creature's tongue before it is retracted by an internal spring. At the end of the tongue in all embodiments, there is a hook and loop surface material area or a slow setting sticky material area which engages a similar surface material area on a small light weight spaced toy prey such that the tongue will stick to the prey and then move the prey towards the opened mouth of the creature.

6 Claims, 3 Drawing Sheets

TONGUE SNATCHING CREEPER TOY

BACKGROUND OF THE INVENTION

Toy figures resembling creeping and crawling animals and reptiles of all kinds have been around for years. Frogs, lizards, snakes, turtles and the like are just some of natures many creatures persons have copied when making these toys. To add realism to such toys, parts of the figures may move as do the real ones to provide for an animated toy figure that more closely resembles a creeping and crawling animal or reptile and its movements.

One of the possible movable parts for the animated toy is the part resembling the tongue, especially when the tongue of the real life creature is used to snatch a potential eatable meal such as a frog extending its tongue to catch and then eat the caught insect. In many cases once the tongue has extended its full length out from the body of the toy creature to attack its prey, the member resembling the tongue must be manually inserted back into the creature's body or mouth or reload to allow the refiring again and the attacking of another prey.

The present invention seeks to over come this reloading necessity by providing for an animated toy with a safe firing extendible appendage or tongue member that will automatically be retracted back into the body of the toy after it has been extended and caught its prey, all as will be described in detail hereafter.

DESCRIPTION OF THE PRIOR ART

Toy figure devices having extendible appendages, such as tongues, are known. For example, in the Wilke invention (U.S. Pat. No. 325,141) a toy resembling an animal snapping its prey is disclosed. An elastic cord attached to the prey is contracted to move the thrown prey back towards the jaws of the predator. The predator's jaws may be closed by either an elastic cord or a spiral spring.

The Lewis patent (U.S. Pat. No. 985,746) discloses a mechanical toy resembling a jumping frog. An internal coil spring is wound and the unwinding of the same causes the frog to jump.

In U.S. Pat. No. 3,738,054 to Petrusek the animal action toy is a tethered animal with an elastic cord to its prey. The thrown tethered prey is caught when the compressed head of the predator opens on the rebound.

In the Lidert, Jr. reference (U.S. Pat. No. 5,391,106) an animated toy figure has an articulated jaw and a spring actuated tongue member. When the toy's mouth is opened the manually extended tongue is automatically recoiled into the mouth upon actuation. Small objects may be attached to the tongue member.

The present invention relates to an animated toy figure having an extendible appendage like a tongue member that can automatically be extended from and retracted back into the figure's body all as more fully set forth in this specification.

SUMMARY OF THE INVENTION

This invention relates to an animated toy with an extendible tongue appendage that can be retracted back into the body of the toy in the preferred embodiment. In another embodiment, air pressure is used to extend the tongue towards its prey. At the end of the tongue in both embodiments, there is a hook and loop material area or a sticky material area which engages similar material on a toy prey such that the tongue will stick to the prey.

It is the primary object of the present invention to provide for an improved animated toy that has an extendible and retrievable appendage member.

Another object is to provide for such a toy wherein the appendage member is resembles the tongue of a creature with a substance that permit the tongue to attach to a prey and withdraw the prey towards the creature.

These and other objects and advantages of the present invention will become apparent to readers from a consideration of the ensuing description and the accompanying drawings.

DESCRIPTION OF THE PREFERRED EMBODIMENT

Figure 1:
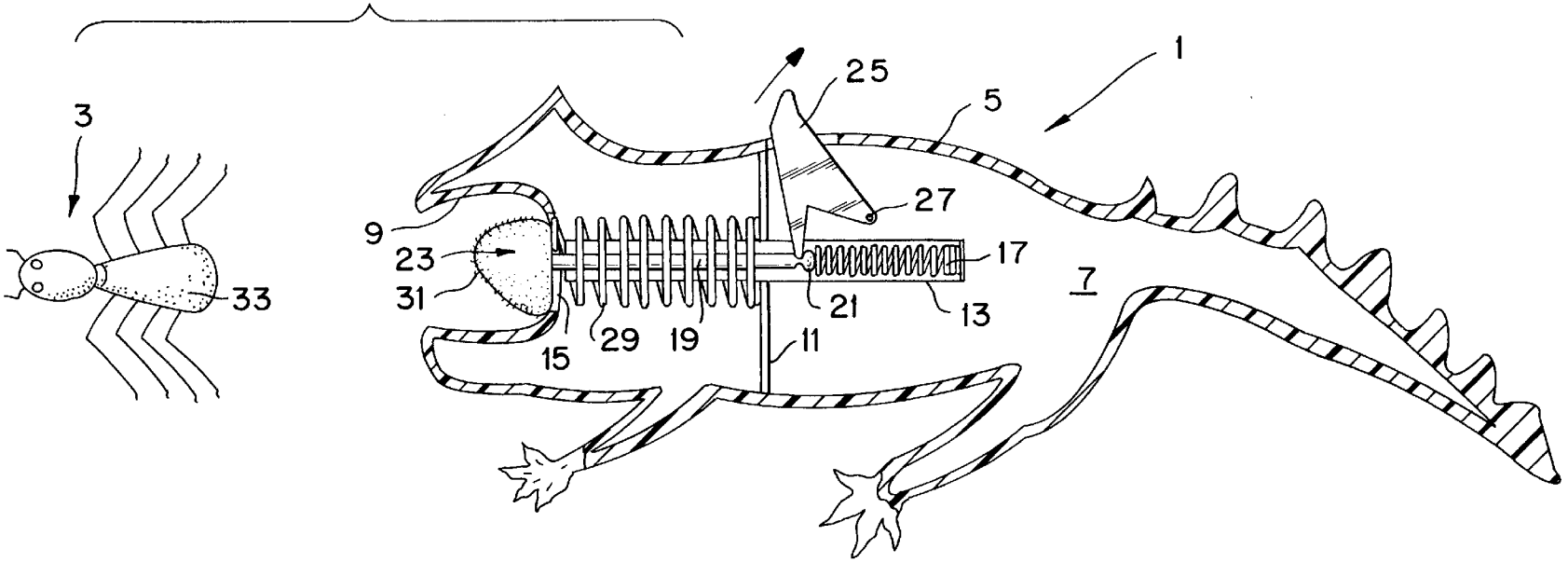
FIG. 1 is a cross section side view of the invention's preferred embodiment showing its internal working and a separate smaller prey.

FIG. 1 is a cross section side view of the invention's preferred embodiments 1 showing its internal working and a separate spaced smaller prey 3. The predator creature 1 in this figure resembles a lizard although other creatures having extendible tongue appendages, such as frogs or snakes, could also be used. Generally, the toy creature's outer body covering 5 surrounds a hollow interior 7 except for the front portion where the opened mouth 9 is located. An internal vertical partition 11 fixed to the opposite interior walls of the creature is used to mount a hollow sleeve 13. This cylindrical sleeve 13 is generally closed on its rear and all sides except for its opened front end 15 located in and facing towards the center of the creature's mouth 9. Within the hollow sleeve 13 is a compressible propeller coil spring 17 that is used to propel the creature's tongue support member 19 from its opened mouth. Conceivably another type of compressible elastic member that is shaped similar could be used in place of the retained coil spring 17.

The member 19 is an elongated straight rod-like member with an enlarged notched rear end 21 and an opposite (front) end tongue shaped member 23. A trigger element 25 is pivotally mounted to rear surface of the body 5 on the body mounted pivot pin 27. When in the notched engaged position the trigger element 25 has a lower protrusion which engages the notched end of the element 19 and acts to retain the compressed spring 17 in its compressed position as shown. When the trigger 25 is pivoted in the direction of the arrow, its formally engaged protrusion is disengaged from the notch in end 21 resulting in the released compressed coil spring 17 expanding forwardly to propel the member 19 out of the creature's front opened mouth 9. Encircling the member 19 is a larger diameter outer retrieval coil spring 29 or similar shaped elastic member. This second spring 29 or elastic member is fixed to the partition 11 at its rear end and to the rear portion of the tongue like member 23 at the spring's front end. As its name indicates, the purpose of this larger outer spring is to retrieve the propelled released tongue support member 19 and move it back towards the creature's opened mouth.

Both the engageable outer surface 31 of tongue 23 and an exposed surface portion 33 on the prey 3 have hook and loop or VELCRO™ surface s that when engaged with each other hold the prey to the surface of the tongue. Alternately, a sticky like material, such as a very slow setting adhesive material, could be applied to the same two engageable surface s on the creature and prey to hold the prey to the creature's tongue. In any case, once the tongue's holding surface 31 briefly contacts the mating surface area of the prey 33, the two touching surface s bond to each other allowing the much smaller and lighter prey to be actually drawn towards the opened mouth 9 of the larger creature 1 as the extended member 19 is retracted back into the creature's opened mouth.

Figure 2:
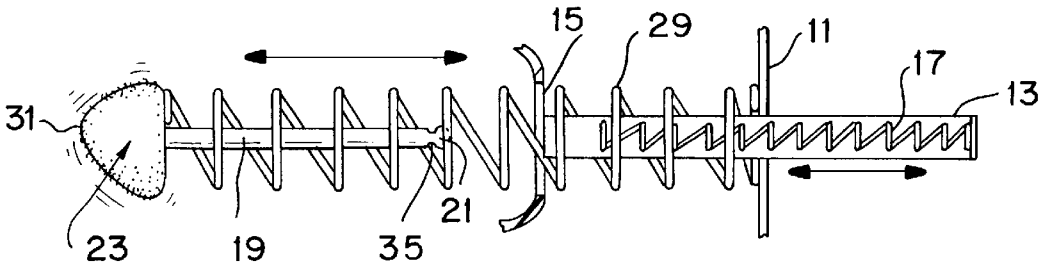
FIG. 2 is a perspective side view of the tongue extendible and retrieval mechanism used in the FIG. 1 embodiment.

FIG. 2 is a perspective side view of the tongue extendible and retrieval mechanism used in the FIG. 1 embodiment. The sleeve 13 and its enclosed coil spring 17 are retained within the body of the creatures (only partly shown by the dotted lines) while the larger diameter outer spring 29 is expanded such that most of this spring (29) extends outside of the creature's body. Also completely outside of the creature's body is the propelled tongue support member 19 attached at its front end of the front end of spring 29. As stated before, the expanded spring 29 is attached at its rear end to the partition 11 fixed to and forming part of the interior of the creatures. The rear end 21 of the tongue support has an enlarged portion with a trigger engage able notch 35 that extends completely around the support's diameter. Thus, after the expanded spring 29 and the enclosed support 19 is fully extended from the opened mouth of the creature 1, the spring 29 will act to retract both itself and the attached carried member 19 with its front tongue 21 back towards and into the creature's opened mouth. By practice a user will be able to determine the distance from the creature the tongue surface area 23 can reach and therefore be able to determine when the prey 3 may be within range and capable of being attracted to the tongue's surface 31.

Figure 3:
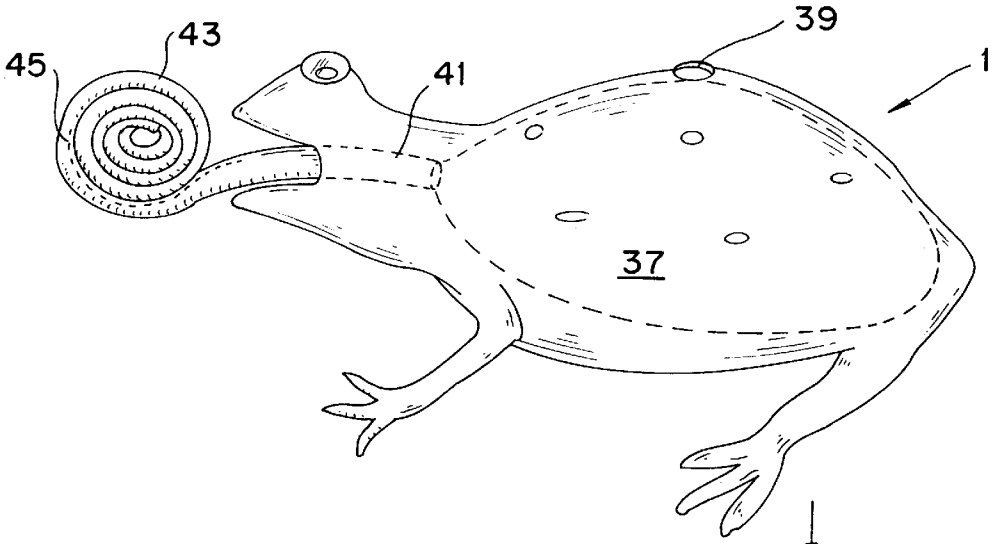
FIG. 3 is a side view of a second embodiment of the invention with an air operated mechanism used to extend the creature's tongue, shown in its retracted position.

FIG. 3 is a side view of a second embodiment of the invention with an air operated mechanism used to extend the creature's tongue, shown in its retracted position. In this second embodiment the creature 1 has a hollow interior which forms an internal chamber 37 shown by dotted lines. By making the body of the creature flexible and resilient, i.e. rubber like, this internal chamber 37 may be deformed by pressing in the creature's body. A small air hole opening 39 is in communication with the interior chamber 37 is used to permit ambient air to be drawn into the deformed creature's interior. In fluid communication with the chamber 37 is an internal exit conduit 41. This same conduit is attached at its front end to a wound hollow interior tongue shaped member 43 having its own attached internal coil spring 45 (shown by dotted lines) used to normally retain the tongue member in the shown wound position. When pressurized air is expended from the creature by compressing the sides of the bellows like chamber 37, this pressurized air expands into the hollow interior of the closed tongue member 43 and overcomes the resistant of the internal spring 45 and unwinds and expand this spring and the member 43 fixed to it along the spring's length much like the noise makers commonly used to celebrate new year's eve.

Figure 4:
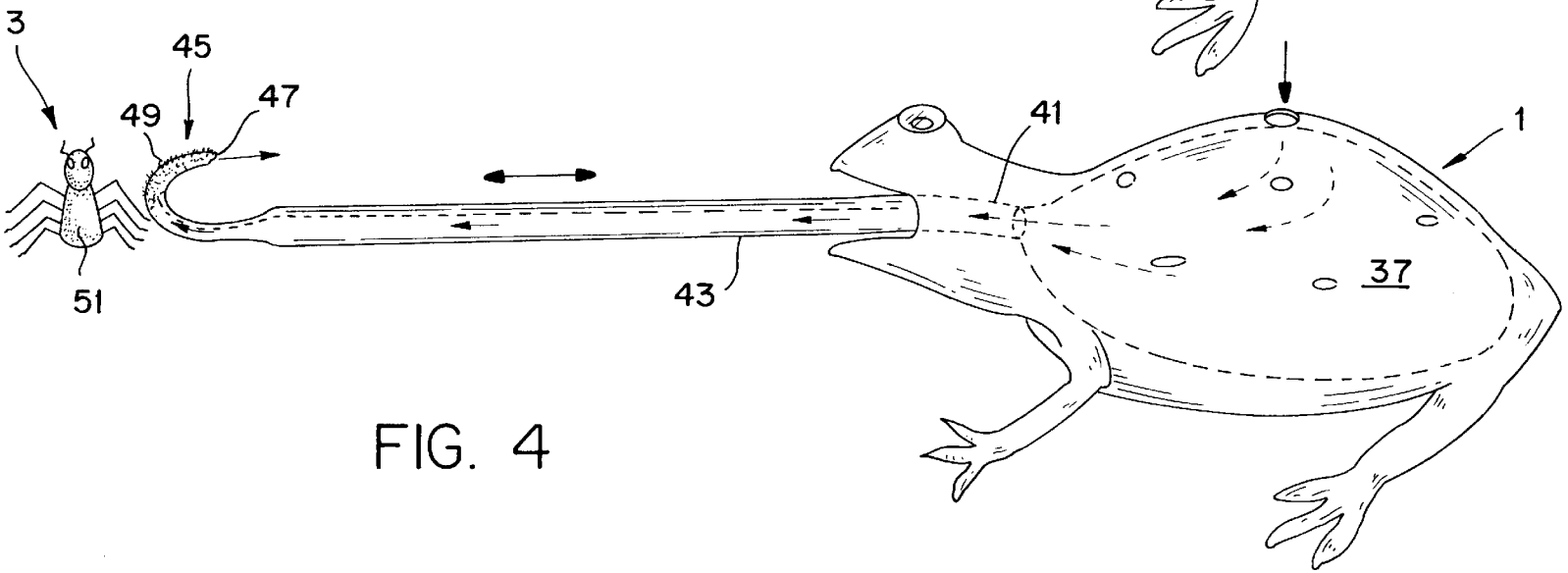
FIG. 4 is a side view of the FIG. 3 embodiment with its tongue extended towards a prey.

FIG. 4 is a side view of the FIG. 3 embodiment with its air inflated tongue member 43 extended towards a prey. The FIG. 3 uninflated tongue member 43 is now inflated and extended as a user squeezes the deformable body of the creature in the direction of the arrow to force compressed air in chamber 37 through internal conduit 41 and into the hollow interior of the member 43. When this happens the member expands from its normally wound state and extends to become generally straight. At the front end of member 43 there is a small air escape hole 47 and an outer hook and look or VELCRO™ surface 49 that can engage and stick to a similar outer surface 51 on the prey 3. When this happens, the internal embedded coil shaped wire spring 45 (shown by dotted lines in surface ) fixed within and along the length of member 43 is strong enough to overcome the now reduced air pressure in the member and return the outer member 43 to its normally wound state, as shown in FIG. 3. Again, practice allow the sticky or attractive surface s of the prey and creature's tongue to momentarily touch each other and permit the prey to be pulled back towards the creature's opened mouth. Like, the first embodiment, a very slow setting bonding material may be used in place of the hook and look fastener materials to hold the prey to the tongue surface of the creature 1.

Figure 5:
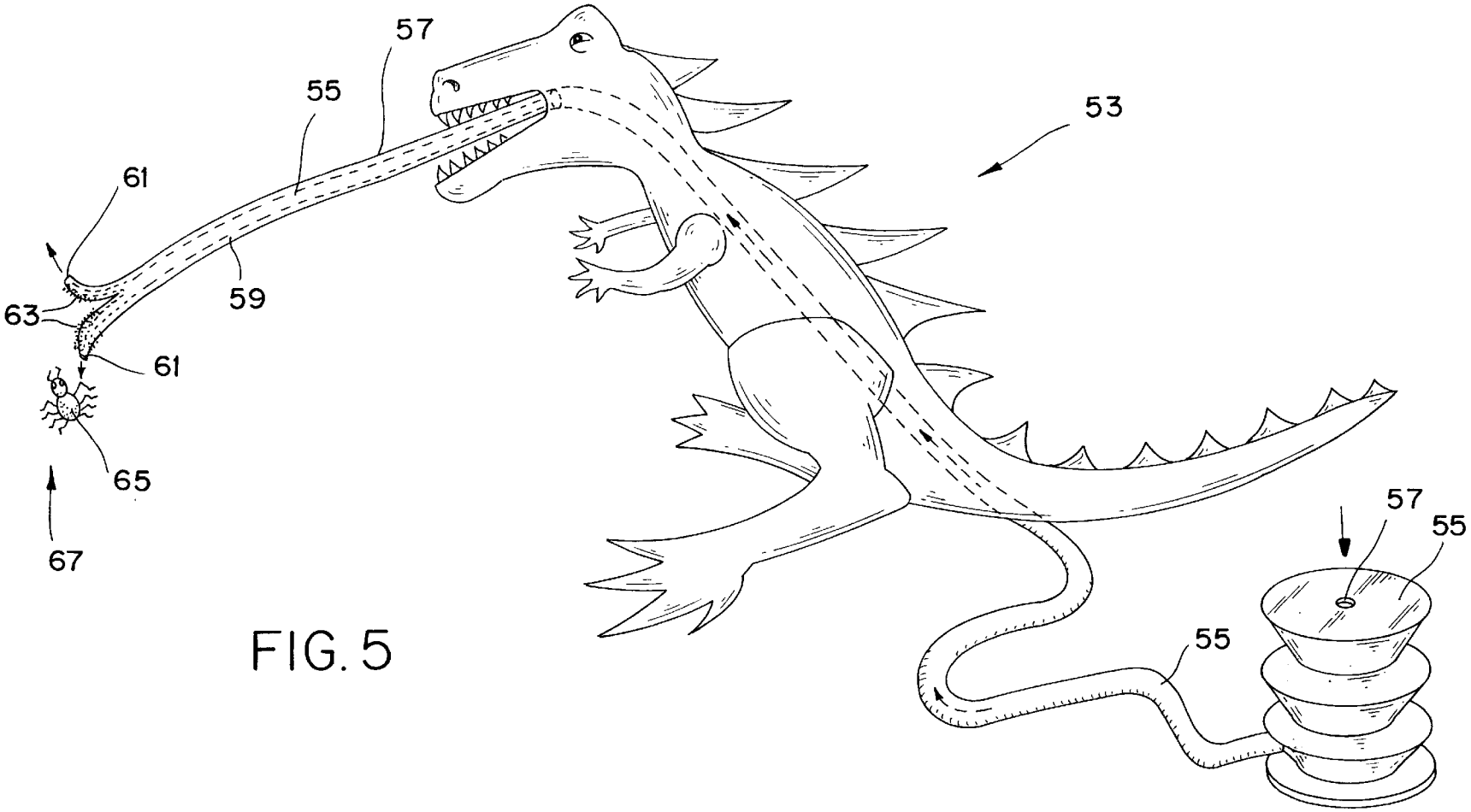
FIG. 5 is a side view of a third embodiment of the invention wherein an air operated mechanism has an exterior bellows to project the creature's tongue.

FIG. 5 is a side view of a third embodiment of the invention wherein an air operated mechanism has an exterior bellows used to provide pressurized air to project the creature's tongue. This embodiment is somewhat similar to the second embodiment in that both are operated by pressurized air to propel a normally retracted tongue member with engageable tongue surface towards a prey that also has an exterior engageable surface material. In this third embodiment, the prey is not shown however, it would resemble the prey shown in FIG. 4 is overall structure. In the third embodiment, the creature 53 resembles a Tyrannosaurus Rex. The hollow interior of the creature has a fluid conduit tubular member 55 that extends along its length to outside the creature to where at its rear it is in fluid communication with a foot operated bellows 55. An upper air intake hole 57 permits ambient air to be taken into the conventional bellows which can then be pressurized by stepping down on the bellow's upper surface. This pressurized air flows through the tubing member 55 through the member 53 and into the creature tongue like member 57. As in the second embodiment, this tongue like member 57 has a retracting spring 59 (shown by dotted lines) fixed along the length of the member 57 that normally retains the tongue in a coiled position. When sufficient pressurized air is pumped into the tubing 55 that extends into and through member 57, which air flows as shown by the arrows in FIG. 5, the tongue is extended. At the front end of tongue member 57 there are two small air escape holes 61 and an outer hook and look or VELCRO™ surface 63 that can engage and stick to a similar outer surface like the surface 65 on the prey 67 shown in dotted line format. The prey 67 and its outer surface may be similar to that shown for the prey of FIG. 4. When the engageable outer surface s on the front end of the creature's tongue meet the outer surface of the prey, the internal tongue embedded deformed coil shaped wire spring 59 (shown as a straight dotted line in the tongue's surface) fixed within and along the length of member 57 is now strong enough to overcome the now reduced air pressure within the tubing 55 of member and return the outer extended member 57 to its normally initial wound state, such as shown by the wound initial state shown for the second embodiment in FIG. 3. As long as air is pumped into the tongue member by the bellows, the tongue will remain extended. However, once the pumping action ceases for a short time, the retracting spring will move the tongue towards the creature's opened mouth. Again, practice allow the sticky or attractive surface s of the prey and extended creature's tongue to momentarily touch each other and this permits the prey to be pulled back towards the creature's opened mouth. Like, the first and second embodiments, a very slow setting bonding material may be used in place of the hook and look fastener materials to hold the prey to the tongue surface of the creature 53.

For all embodiments, by providing for both an extendible tongue on a creeper eater that can be attached to a prey and then pulling the caught prey back toward's the opened mouth of the creature, a game can be made out of seeing how many preys can be caught within a given time. In all three embodiments, the prey is both caught and then pulled back towards the creature providing for a very realistic action. Practice will dictate the distance between the creature and prey needed to catch a static prey as the creature moves into position and then has its tongue fired towards the prey. If the attractive surface areas on the tongue and prey meet for only a second the smaller and much lighter prey will be attracted to the creature's tongue as it then is withdrawn back towards the creature.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An animated toy with an extendible and retrievable appendage member comprising:

a toy creature having a hollow interior body and a front opened mouth portion;

an expandable and retractable tongue like member inserted in said creature's opened mouth portion, said expandable and retractable member having a rear end attached to said creature and an opposite front end whose outer surface resembles that of the tongue of the toy creature;

spring biased members to propel and retract said expandable and retractable member from the opened mouth of the creature;

said spring biased members including a first inner spring within a sleeve that is attached to the creature and a second outer spring attached to the creature and to the creature's front end resembling a tongue that is used to retract the propelled tongue;

said front end resembling a tongue having an attractive outer front surface area thereon adapted to engage and be retained by an outer surface area on a prey toy; and a prey toy spaced from said creature and having an outer attractive surface area that can engage the outer surface area of said front end resembling a tongue and be retained thereon.

2. An animated toy with an extendible and retrievable appendage member comprising:

a toy creature having a hollow interior body and a front opened mouth portion;

an expandable and retractable tongue like member inserted in said creature's opened mouth portion, said expandable and retractable member having a rear end attached to said creature and an opposite front end whose outer surface resembles that of the tongue of the toy creature;

said creature's hollow interior body having an interior fluid conduit that is in fluid communication with an external fluid pressure generating bellows at one end and with the expandable and retractable tongue like member at its other end;

a tongue retracting member extending along the length of said tongue like member for retracting the tongue like member back towards the mouth of the creature after sufficient pressurized fluid escapes from the fluid outlets;

said fluid conduit extending substantially the entire length of said tongue like member and having a fluid outlet near its front end;

said front end resembling a tongue having an attractive outer front surface area thereon adapted to engage and be retained by an outer surface area on a prey toy; and a prey toy spaced from said creature and having an outer attractive surface area that can engage the outer surface area of said front end resembling a tongue and be retained thereon.

3. The animated toy as claimed in claim 1, wherein attractive outer surface area on said front end resembling a tongue and said prey toy are both made of materials that have hook and loop surface areas.

4. The animated toy as claimed in claim 1, wherein attractive outer surface area on said front end resembling a tongue and said prey toy both have sticky slow setting engaging surface areas.

5. The animated toy as claimed in claim 2, wherein attractive outer surface area on said front end resembling a tongue and said prey toy are both made of materials that have hook and loop surface areas.

6. The animated toy as claimed in claim 2, wherein attractive outer surface area on said front end resembling a tongue and said prey toy both have sticky slow setting engaging surface areas.

* * * * *